US005749386A

United States Patent [19]

Samuel, Jr.

[11] Patent Number: 5,749,386

[45] Date of Patent: May 12, 1998

[54] GOLF UMBRELLA AND SUPPORT

[76] Inventor: Vincent D. Samuel, Jr., 6561 Mulholland, Cincinnati, Ohio 45140

[21] Appl. No.: 733,729

[22] Filed: Oct. 18, 1996

[51] Int. Cl.[6] ..... A45B 11/00

[52] U.S. Cl. ..... 135/16; 135/118; 248/530; 248/545

[58] Field of Search ..... 135/16, 66, 98, 135/99, 118, 77–81; 248/156, 530, 532, 533, 545, 548, 96, 522

[56] References Cited

U.S. PATENT DOCUMENTS

| | | | |
|---|---|---|---|
| 1,613,287 | 1/1927 | Moser . | |
| 3,318,560 | 5/1967 | Garrette, Jr. et al. . | |
| 3,730,197 | 5/1973 | Lunney . | |
| 4,131,122 | 12/1978 | Brooks | 248/532 |
| 4,733,681 | 3/1988 | Lee . | |
| 4,832,304 | 5/1989 | Morgulis | 248/533 |
| 5,152,495 | 10/1992 | Jacinto et al. | 135/98 X |
| 5,156,369 | 10/1992 | Tizzoni | 248/545 |
| 5,293,889 | 3/1994 | Hall et al. . | |
| 5,396,916 | 3/1995 | Boissonnault | 135/16 |
| 5,482,246 | 1/1996 | Derkoski | 248/530 |
| 5,535,978 | 7/1996 | Rodriguez et al. | 135/118 X |

FOREIGN PATENT DOCUMENTS

| | | | |
|---|---|---|---|
| 0312675 | 4/1989 | European Pat. Off. . | |
| 1272460 | 4/1972 | United Kingdom | 135/16 |
| 1278557 | 6/1972 | United Kingdom | 135/16 |
| 2020967 | 11/1979 | United Kingdom | 135/66 |

*Primary Examiner*—Lanna Mai
*Attorney, Agent, or Firm*—Harpman & Harpman

[57] ABSTRACT

A combination telescopically adjustable golf umbrella stand and self-supporting golf umbrella adapted to be engageable into the ground by a spike extending from the lowermost portion. A spike attachment fitting allows the spike to be removably secured to and/or stored within the umbrella's uppermost portion. An umbrella handle mount on the umbrella stand has adjustable straps that engage and encircle the umbrella handle positioned within. An integral deployable umbrella extends from the self-supporting golf umbrella providing an all in one unit.

19 Claims, 7 Drawing Sheets

GOLF UMBRELLA AND SUPPORT

BACKGROUND OF THE INVENTION

1. Technical Field

This device relates to umbrellas and support structures of the type typically used in outdoor sports such as golf and the like.

2. Description of Prior Art

Prior art devices of this type have been utilized in the past to provide hand held large umbrellas to shield the user from natural elements, such as rain, encountered on a golf course. Typically, the "golf" type umbrellas are oversized umbrellas having a large handle portion and are carried collapsed with the golf equipment. In use, such umbrellas are held by the golfer during play.

Free standing umbrellas of sufficient height to stand under typically are found in beach environments where insertion into the sand is a relatively easy and self-supporting surface. Umbrellas heretofore required an elaborate ground engaging designs usually of a screw-type fixture with associated outriggers for stability which require a rather unyielding space consuming structure, see for example U.S. Pat. No. 5,293,889.

Telescopically extensible hand held umbrellas are well known and provide a compact storage and transportable package that can be extended to full size for use, see for example U.S. Pat. No. 1,613,287.

An intermediate umbrella design can be seen in U.S. Pat. No. 3,730,197 that provides a bag with a collapsible umbrella that can be carried by the user, thus holding the extensible umbrella in the desired location.

A combination golf ball retrieval umbrella is also illustrated as an example of golf umbrellas shown in U.S. Pat. No. 4,733,681.

SUMMARY OF THE INVENTION

A free standing combination golf umbrella and stand having a telescopically extensible support post with an integral umbrella mounting fitting to support a golf umbrella. The support post has a ground engagement spike removably secured to its lowermost portion. The spike has multiple contours with a user engageable insertion rest pivotally deployable therefrom during use. The ground engagement spike is storable within an upper end portion of the support post.

DESCRIPTION OF THE PREFERRED EMBODIMENT

Figure 1:
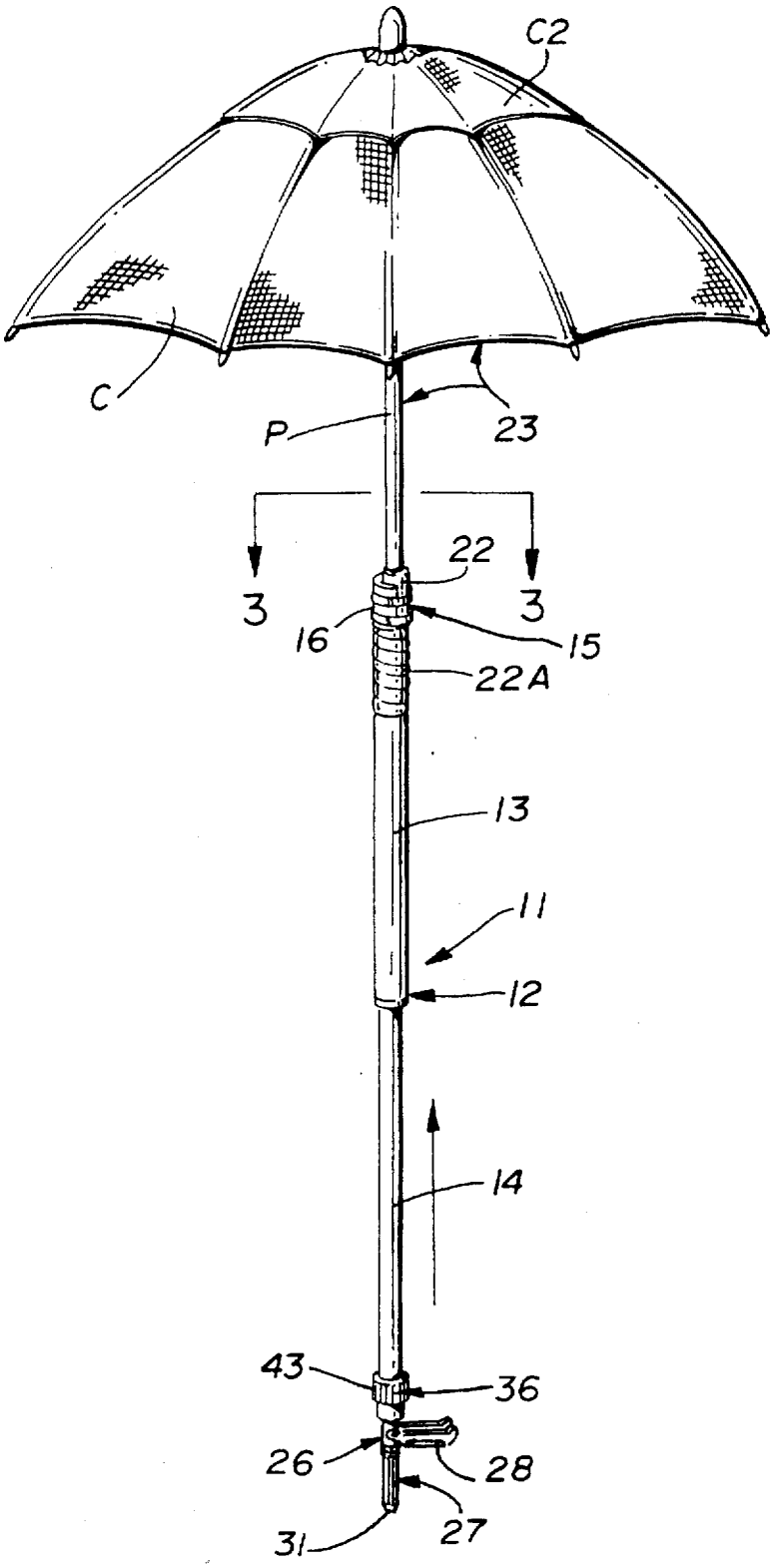
FIG. 1 is a perspective view of the combination golf umbrella and stand of the invention.
Figure 2:
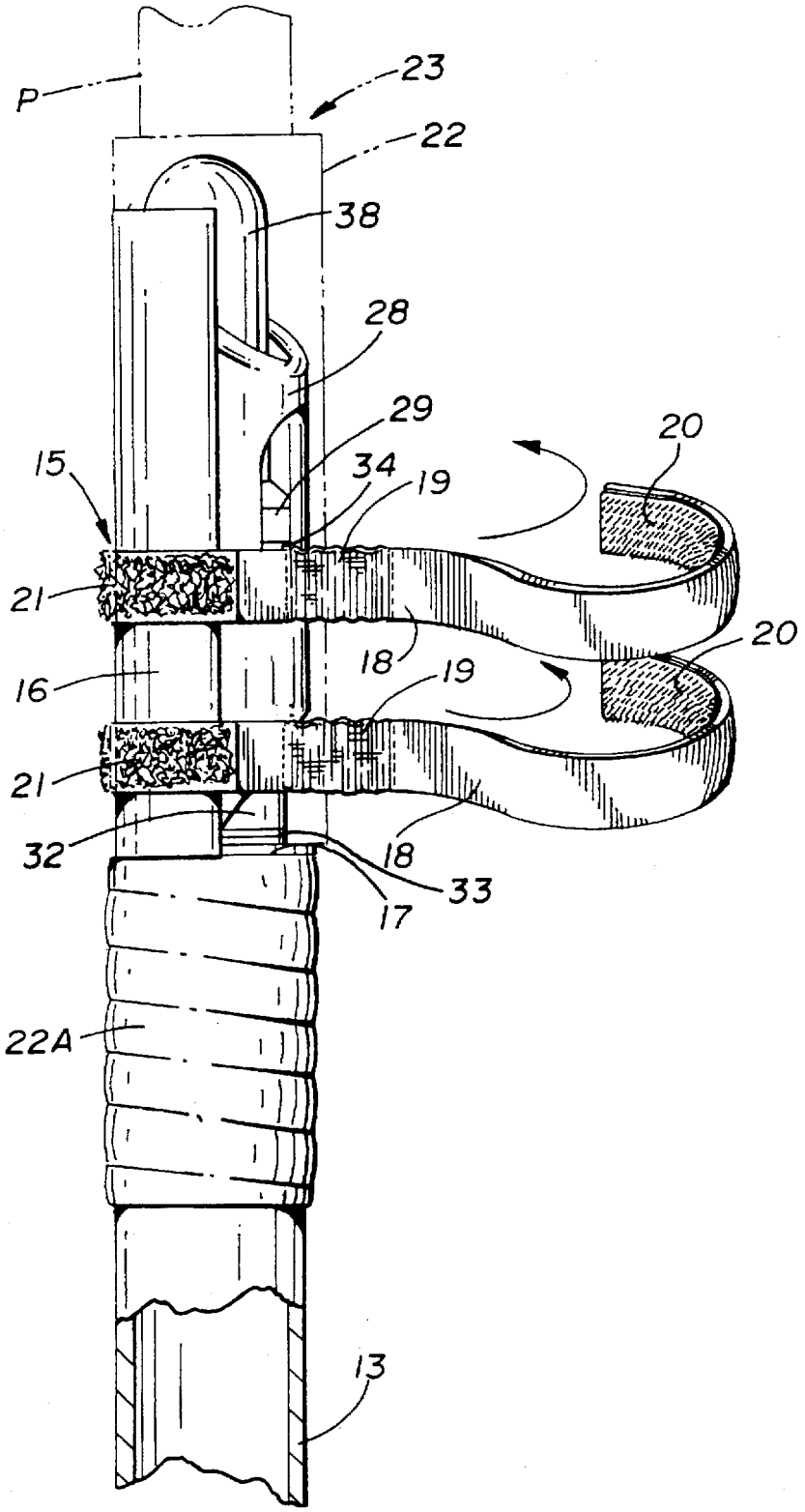
FIG. 2 is an enlarged elevational view of an upper portion of the stand in storage position.
Figure 3:
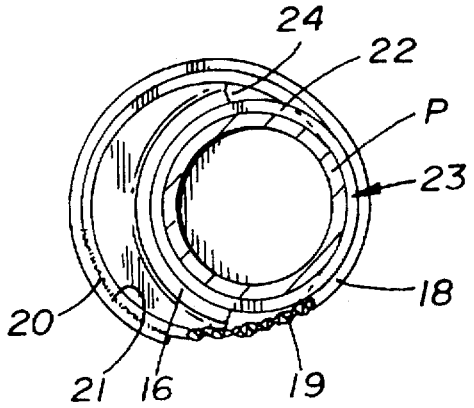
FIG. 3 is an enlarged cross-sectional view on lines 3—3 of FIG. 1.

Referring to FIGS. 1–8 of the drawings, a new improved combination golf umbrella 10 and golf umbrella stand 11 can be seen. The golf umbrella stand 11, best seen in FIGS. 1–3 of the drawings comprises a telescopically extensible two-part post 12 having an interengaging upper and lower sections 13 and 14. An umbrella receiving fitting 15 extends from the upper section 13 having a U-shaped upstanding channel portion 16 with a storage insert portion 17. Attachment straps 18 extend from the channel portion 16 each of which has elastic insert portions 19 and hook 20 and loop 21 fastening material (velcro) thereon. The straps 18 are of a sufficient length to wrap about a handle portion 22 of a typical golf umbrella 23 and onto themselves, as best seen in FIG. 1 of the drawings interengaging the hook and loop material 20 and 21 respectively and shown in broken lines in FIG. 2 of the drawings. An inner handle engagement surface 24 is textured for frictional registration of the handle portion 22 when inserted in same. A grip material 22A is wrapped about the upper portion 13 from the umbrella receiving fitting 15 to provide a gripping surface.

A ground engagement spike assembly 26 is removably secured to the free end of the post's lower portion 14. The spike assembly comprising a ground spike 27, a foot pedal 28 and a snap in mounting portion 29, best seen in FIGS. 5 and 9 of the drawings. The spike 27 has a cylindrical circumferentially elongated longitudinally extending parallel facets 30 terminating at a ground engagement point 31. A storage mounting area 32 extends from the facets 30 having oppositely disposed recessed apertured mounting portions 33 for pivotally mounting the foot pedal 28 thereto. The snap in mounting portion 29 is removably secured within the lower free end of the post section 14.

Figure 9:
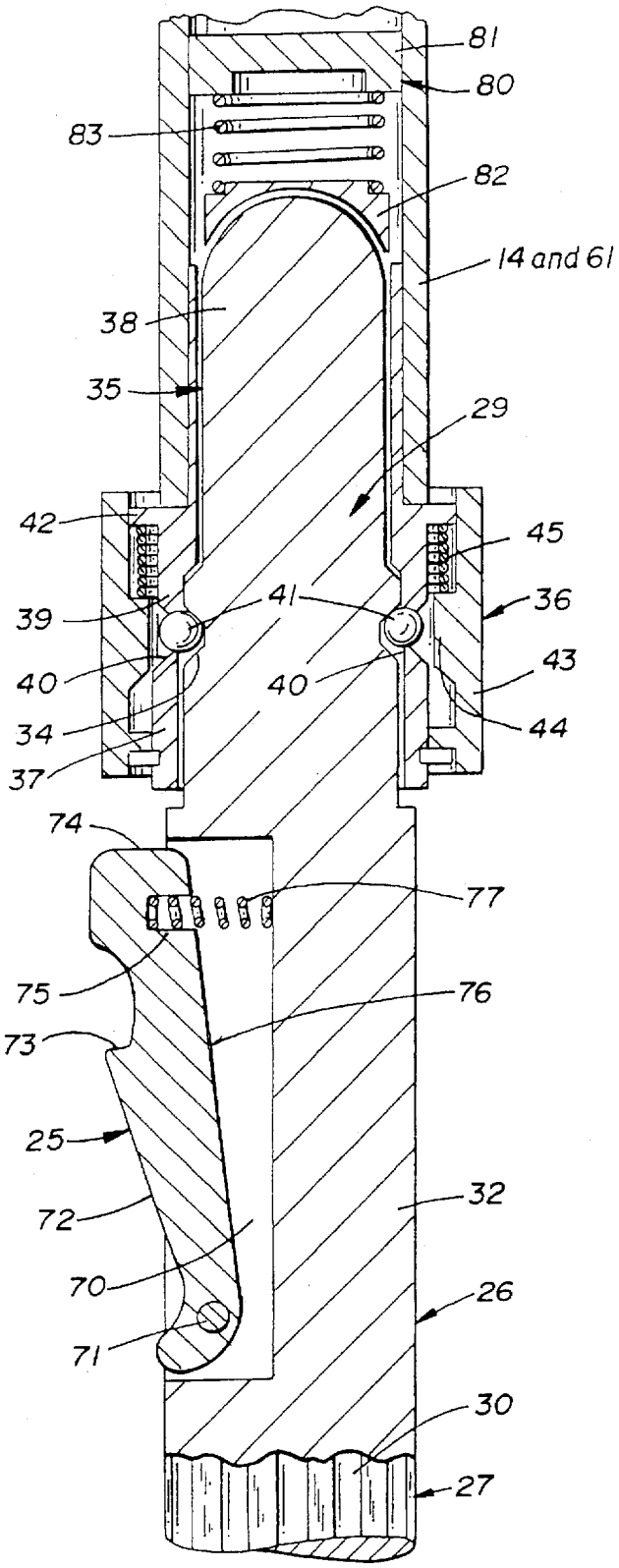
FIG. 9 is an enlarged partial cross-sectional view of the ground engagement spike assembly within a lower portion of the support post.

The snap-in mounting portion 29 has an annular locking groove 34 therein with a post insert guide portion 35 of a reduced diameter extending therefrom, best seen in FIG. 9 of the drawings.

A spike receiving fitting 36 in the post 14 has a main body member 37 with a post portion 38 and a spike retaining portion 39 having a plurality of oppositely disposed apertures at 40 with respective retaining spheres 41 therein. A spring retaining annular flange 42 extends from said spike retaining portion 39 adjacent said post portion 38. A sliding sleeve 43 is positioned on the spike retaining portion 39 having an inturned annular retaining flange 44 selectively registerable against said retaining spheres 41. The sliding sleeve 43 is spring urged by a spring 45 around the spike retaining portion 39 between the spring retaining flange 42 and inturned flange 44 as will be well understood by those skilled in the art.

A storage and locking release arm 25 is positioned within an elongated release slot 70 within the mounting area 32. The release arm 25 is pivotally secured within the recessed slot 70 by a pivot pin 71 which has an contoured outer engagement surface 72 with an engagement notch 73 inwardly from its upper end at 74. A spring mounting bore 75 is formed an inner edge surface 76 with a spring 77 positioned therein so as to urge the locking and release arm 25 outwardly from the recessed slot 70.

Figure 5:
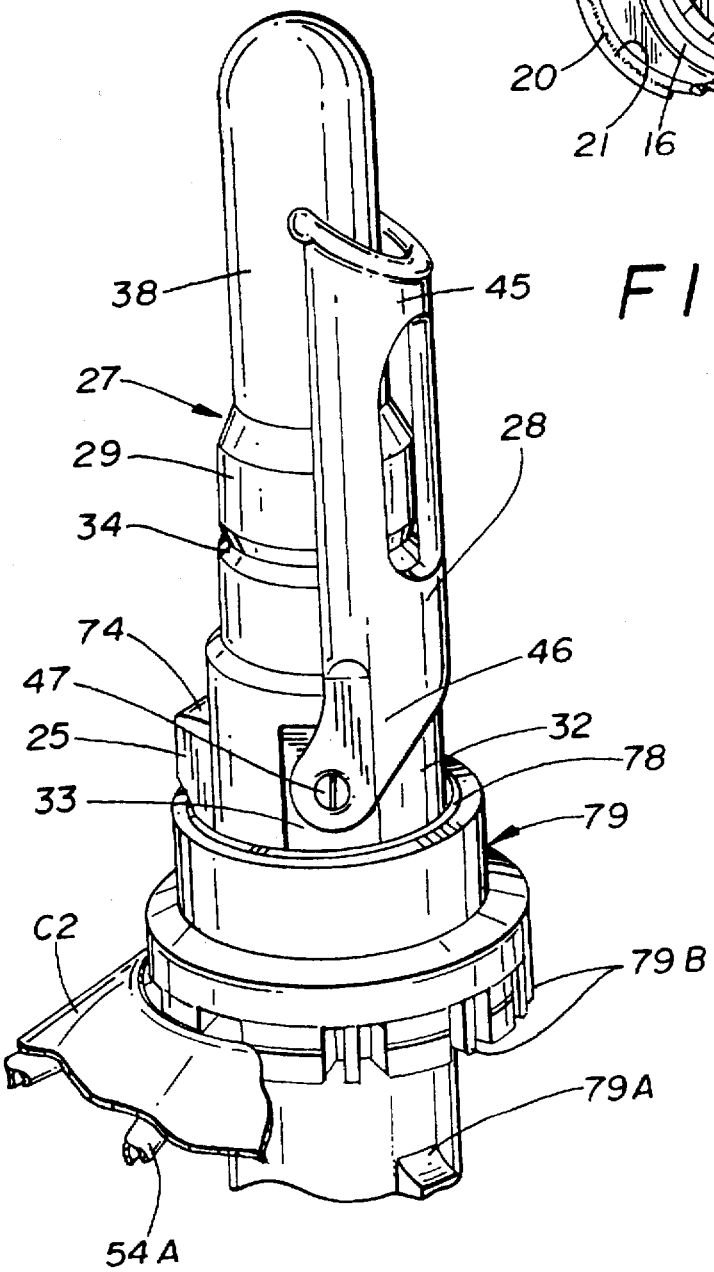
FIG. 5 is an enlarged perspective view of the spike stored within a portion of the integral golf umbrella.
Figure 8:
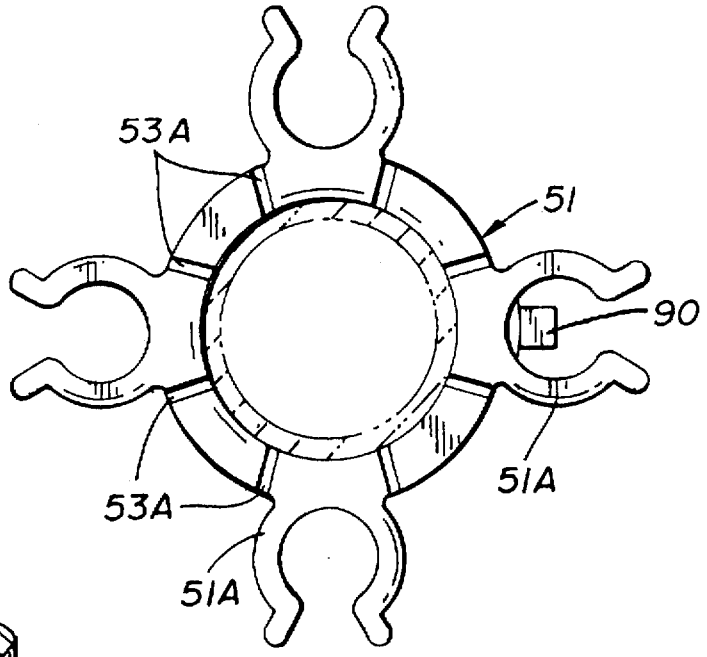
FIG. 8 is an enlarged top plan view of an umbrella support deployment hub and club holder assembly.
Figure 4:
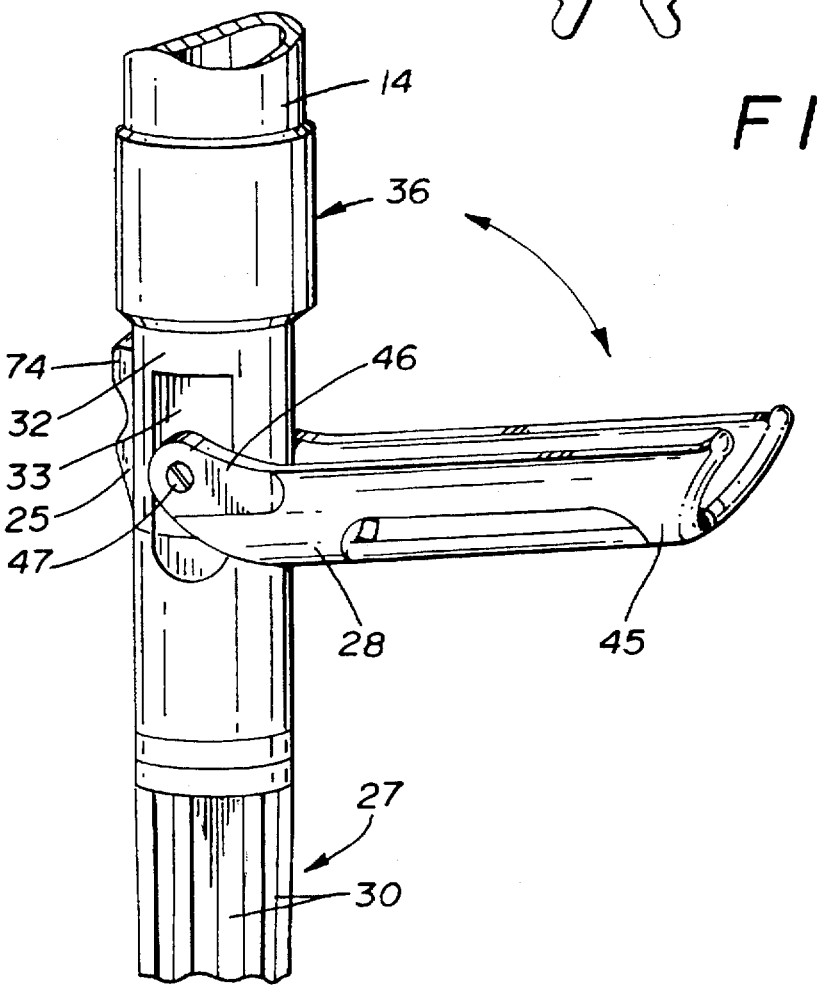
FIG. 4 is an enlarged perspective view of a portion of the ground engagement spike assembly of the invention in deployed position.
Figure 6:
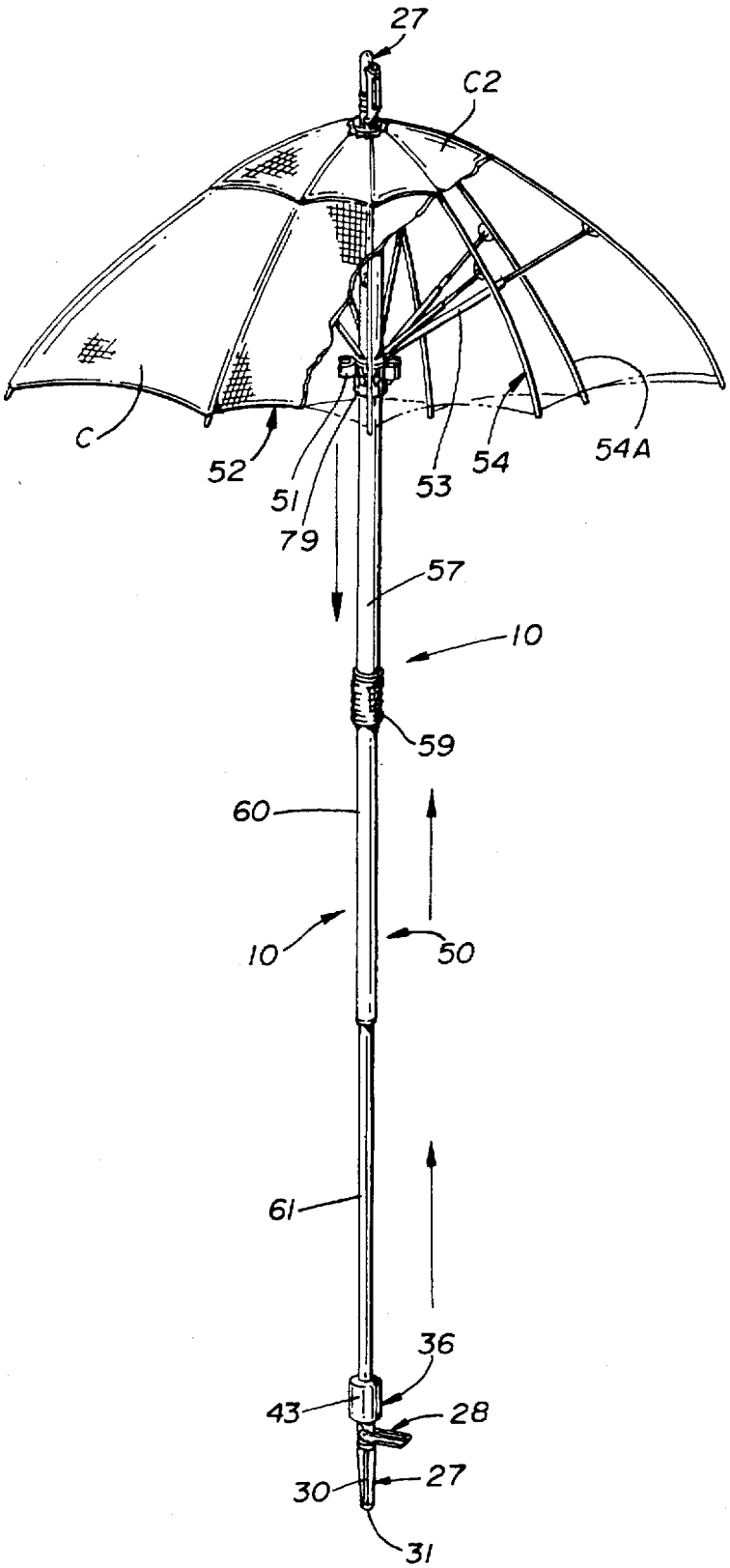
FIG. 6 is a perspective view of the integral golf umbrella deployed with portions broken away.

The foot pedal 28 has an elongated contoured engagement portion 45 and an apertured bifurcated mounting portion 46, best illustrated in FIGS. 4 and 5 of the drawings. A pivot pin 47 is movably secured within the mounting portion 46 to the respective mounting portions 33.

Referring now to FIGS. 3–7 of the drawings, the golf umbrella 10 can be seen having a telescopically extensible three-part support post 50 with the spike assembly 26 as hereinbefore described. It will be seen that an integral golf umbrella 52 extends from an upper section 57 of the support post 50 having a folding umbrella, rib support assembly 54 having main canopy support ribs 54A and interconnecting deployment ribs 53 as is well known to those skilled in the art. The upper section 57 has a textured rubber grip 59 thereon and telescopically extensible tubular sections 60 and 61 which extend from the post 57.

Figure 10:
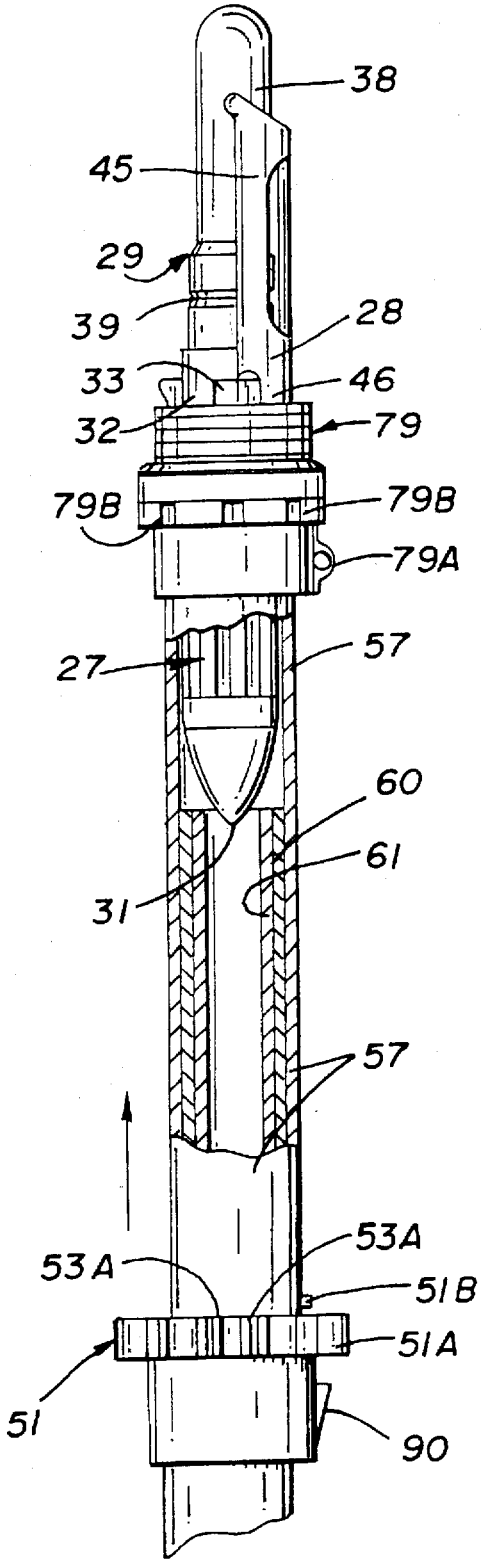
FIG. 10 is an enlarged partial cross-sectional view of the ground engagement spike assembly in stored position within an upper portion of the integral umbrella's support post.

The umbrella rib support assembly 54 has a modified rib activation hub 51 movably positioned on the upper section 57 from a closed position to an open lock position by a locking button 90, see FIG. 10 of the drawings. The activation hub 51 has a plurality of club clips 51A extending radially therefrom with deployment ribs 53 pivotally secured in slots 53A between said club clips 51A.

The activation hub 51 acts to open and close the umbrella 52 which has a typical release button 51B within the upper section 57, with the added advantage of the club engagement clips 51A as noted.

Figure 7:
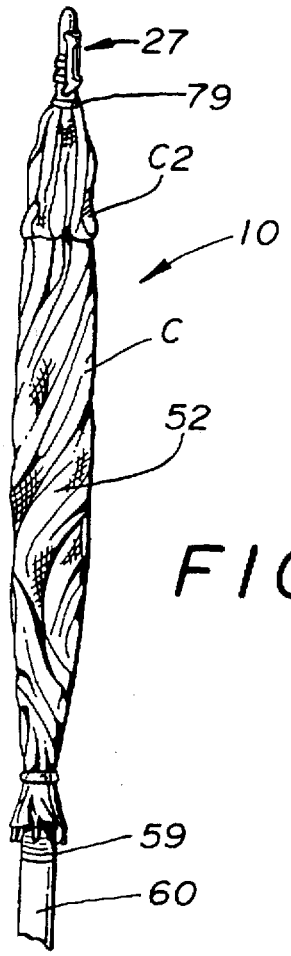
FIG. 7 is a perspective view of the integral golf umbrella in the closed transportable position.

The spike assembly 26 of the invention can be removed from its corresponding spike receiving fitting 36 positioned within the lower free end of said extensible section 61, the same as described in umbrella stand 11, and stored in the upper open free end of post section 57 as illustrated in FIGS. 5 and 10 of the drawings by frictional engagement of the locking release arm 25 against an annular locking rib 78 within a modified rib and storage hub 79, best seen in FIG. 5 of the drawings for transportation with the extensible portion section 60 and 61 telescopically fitted within one another and section 57 defining a fully collapsed umbrella 10 as illustrated in FIGS. 7 and 10 of the drawings. An apertured accessory tab 79A extends from the rib and storage hub 79 as best seen in FIG. 10 of the drawings. The rib and storage hub 79 has circumferentially spaced rib engagement fittings 79B for receiving the canopy support ribs 54A therein, not shown in FIGS. 5 and 10 for clarity.

Referring now to FIG. 9 of the drawings, a spring loaded receptacle 80 can be seen within said post section 14 and corresponding tubular section 61 inwardly of its free end for registration with said mounting portion 29 of the ground engagement spike 26. The receptacle 80 has a fixed base insert 81 and a movable contoured cap engagement portion 82 with a spring 83 therebetween. In use, as the spike assembly 26 is inserted into the respective post 14 and/or extensible section 61, the mounting portion 29 engages and is held in aligned position within the respective areas by the cap portion 82. Both the golf umbrella 23 shown in FIG. 1 of the drawings as removably secured to the umbrella stand 11 and the integral golf umbrella 52 of the golf umbrella 11 have a fabric canopy covering C with a wind vent secondary canopy C2 thereon as is found in golf umbrellas currently available. The golf umbrellas 23 and 52 are collapsible by disengagement of respective rib support assemblies as is typically found in collapsible umbrellas of this type to a folded position which is shown generally in FIG. 7 of the drawings.

Both the golf umbrella 10 and the umbrella stand 11 provide for storage of the spike assembly 26 within the respective upper support post portions 57 and 13 securing the spike assembly 26 within by the locking release arm 25.

Thus it will be seen that a new and novel golf umbrella and golf umbrella stand has been illustrated and described and it will be apparent to those skilled in the art that various changes and modifications may be made therein without departing from the spirit of the invention.

Therefore I claim:

1. A golf umbrella comprising; a plurality of interconnected tubular sections slideably endwise within one another, said tubular sections having an upper portion, and a lower portion, an umbrella extending from the free end of said upper portion, a ground engaging spike extending from said distal end of said lower portion, a ground insert pedal pivotally secured to said spike, means for selectively removing said spike from said lower portion, means for storing said spike in said upper portion of said tubular sections and means for activating said umbrella.

2. The umbrella of claim 1 wherein said ground insert pedal is bifurcated for pivotally mounting to said spike.

3. The golf umbrella of claim 1 wherein said means for storing said spike in said respective upper portions of said tubular sections comprises; a storage mounting area on said spike, a release arm extending from said spike, means for resiliently mounting said release arm within said spike and engagement means for said arm in said upper portions of said tubular sections.

4. The golf umbrella of claim 3 wherein said means for resiliently mounting said release arm comprises: a spring extending therefrom.

5. The golf umbrella of claim 3 wherein said arm engagement means comprises an annular locking flange in said upper portions of said respective tubular sections.

6. The golf umbrella of claim 1 wherein said means for selectively removing said spike from said tubular section's lower portion comprises: a snap-in mounting portion on said spike, and a spike retaining fitting in one of said tubular sections.

7. The golf umbrella of claim 6 wherein said mounting portion on said spike has an annular locking groove therein.

8. The golf umbrella of claim 6 wherein said spike retaining fitting comprises: a spike retaining portion, a plurality of retaining spheres within said spike retaining portion, a sleeve movably positioned on said spike retaining portion selectively engaging said retaining spheres, means for resiliently securing said sleeve on said spike retaining portion and means for aligning said mounting portion within said tubular section's lower portion.

9. The golf umbrella of claim 8 wherein said means for resiliently securing said sleeve on said spike retaining portion comprises: a spring retaining flange, a spring between said flange and said sleeve and a retaining ring.

10. The golf umbrella of claim 8 wherein said means for aligning said mounting portion within said tubular section comprises: a spring-urged contoured cap portion.

11. The golf umbrella of claim 1 wherein said means for activating said umbrella comprises a rib activation hub on one of said tubular sections, said hub having a plurality of club clips extending radially therefrom, said hub movable on said tubular sections and deployment ribs pivotally secured to said activation hub.

12. A golf umbrella stand comprising: a plurality of interconnected tubular sections slideably endwise within one another, said tubular sections having an upper portion and a lower portion, an umbrella receiving socket on the free end of said section's upper portion, a ground engagement spike extending from said distal end of said section's lower portion, a ground insert pedal on said spike, means for selectively removing said spike from said section's lower portion and means for storing said spike in said umbrella receiving socket.

13. The golf umbrella stand of claim 12 wherein said umbrella receiving socket comprises: an upstanding portion and a base portion, strap elements extending from said upstanding portion, means for selectively securing a portion of said strap elements onto themselves.

14. The golf umbrella stand of claim 13 wherein portions of said strap elements are elastic.

15. The golf umbrella stand of claim 13 wherein said means for selectively securing a portion of said strap elements to themselves comprises hook and loop material positioned on respective overlapping portions of said straps.

16. The golf umbrella stand of claim 12 wherein said ground insertion pedal is bifurcated for pivotally mounting said on said spike.

17. The golf umbrella stand of claim 12 wherein means for selectively removing said spike from said tubular section comprises: a snap-in mounting portion on said spike, and a spike receiving fitting in said tubular section.

18. The golf umbrella stand of claim 12 wherein said means for storing said spike in said upper portion of said tubular section comprises: an opening in said umbrella receiving socket and locking means therein.

19. The golf umbrella of claim 13 wherein said upstanding portion of said receiving socket has a textured surface area thereon.

* * * * *